US006854186B2

(12) United States Patent
Basden et al.

(10) Patent No.: US 6,854,186 B2
(45) Date of Patent: Feb. 15, 2005

(54) LOCKABLE KNIFE BLOCK

(76) Inventors: Nicholas Bernard Basden, 13 Buckingham Mansions 353 West End Lane, London, NW6 1LR (GB); Stephen Boyd Ratchye, 501 N. Venice Boulevard, #37, Venice, CA (US) 90291

( * ) Notice: Subject to any disclaimer, the term of this patent is extended or adjusted under 35 U.S.C. 154(b) by 0 days.

(21) Appl. No.: 10/389,598

(22) Filed: Mar. 17, 2003

(65) Prior Publication Data

US 2004/0181948 A1 Sep. 23, 2004

(51) Int. Cl.[7] ..... B26B 27/00

(52) U.S. Cl. ..... 30/298.4; 30/286; 248/37.3; D7/637

(58) Field of Search ..... 30/296, 286, 298.4, 30/296.1; 211/70.7; D7/637, 601; 206/553; 248/37.3; 220/4.03, 8, 293, 290

(56) References Cited

U.S. PATENT DOCUMENTS 4,423,552 A * 1/1984 Bourgein et al. ..... 30/298.4
4,601,400 A * 7/1986 Buchanan et al. ..... 211/70.7
4,604,836 A * 8/1986 Huang ..... 451/555
4,666,036 A * 5/1987 Bourbon ..... 206/45.23
4,866,845 A * 9/1989 McEvily ..... 30/138
5,245,756 A * 9/1993 Howell et al. ..... 30/298.4
5,775,518 A * 7/1998 Connor ..... 211/70.7
D422,850 S * 4/2000 Ancona et al. ..... D7/637
6,058,609 A * 5/2000 Yen et al. ..... 30/298.4
6,079,108 A * 6/2000 Lin ..... 30/298.4
6,371,312 B1 * 4/2002 Tsuchida ..... 211/70.7
6,375,016 B1 * 4/2002 Stuchlik, III ..... 211/70.7
6,439,403 B1 * 8/2002 Levsen ..... 211/70.7
6,581,774 B1 * 6/2003 Galafassi et al. ..... 206/553
6,643,949 B2 * 11/2003 Yen ..... 34/202

* cited by examiner

*Primary Examiner*—Boyer Ashley
*Assistant Examiner*—Phong Nguyen

(57) ABSTRACT

This invention is a knife block for storing cutlery that can be locked to prevent the removal of the knives. An adjustable cap piece rests in one of two positions. In the unlocked position, the cap fits snugly over the base and the knives project up through holes in the cap. In the locked position, the cap is raised and rotated so the knives are inside the cap and inaccessible. The locking mechanism requires adult understanding and hand size to operate, greatly enhancing kitchen safety. In addition, this locking knife block requires no alteration of the knives.

1 Claim, 9 Drawing Sheets

LOCKABLE KNIFE BLOCK

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

Knife blocks for storing cutlery typically consist of a solid block of material with a number of parallel slots that hold the knife blades. The handles stick up, which leaves the knives exposed for small children to grab and potentially hurt themselves. This invention is a knife block that can be locked to safeguard knives and other sharp objects (e.g., kitchen shears) from small children. In addition, this invention uses a locking mechanism that does not require any alterations to the knives, a drawback of other lockable knife blocks. Finally, this knife block has few parts, which makes it easy to manufacture.

BRIEF SUMMARY OF THE INVENTION

This invention is a knife block that can be locked to safeguard knives and other sharp objects (e.g., kitchen shears). In the unlocked position, a cap with holes in the top fits down snugly on the block base. In this position, the holes in the cap are aligned with the knife handles such that they protrude through the cap and the knives are available for use. To lock the knife block, the user raises the cap above the knife handles and rotates it, confining the knives within the cap and rendering them inaccessible because of the changed orientation of the holes in the cap, i.e., perpendicular to the knife handles. Depressible catch pieces lock the cap in place. To unlock it, the user depresses the catch pieces and rotates and lowers the cap.

DETAILED DESCRIPTION OF THE INVENTION

Figure 1:
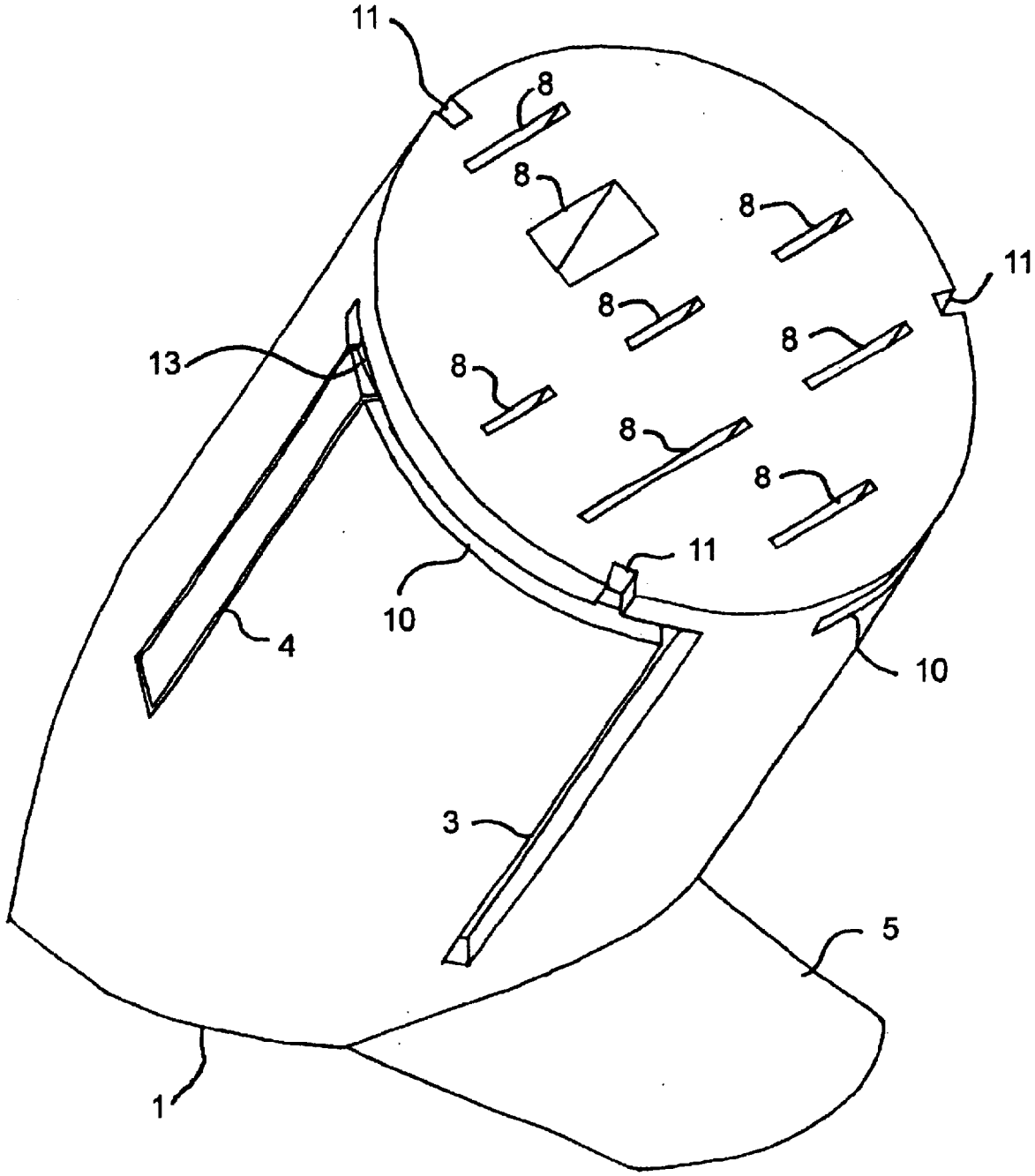
FIG. 1 is a perspective view of the base.

Referring to FIG. 1, the base 1 of the knife block is made of pressed wood or a plastics polymer. The base 1 has slots 8 for the knives' blades like most knife blocks. The upper part of the base 1 is cylindrical. A "foot" 5 projects from the front of the base 1 for stability. On the sides of the base 1 are three narrow grooves 3 oriented close to the vertical, which will be referred to as "vertical grooves". Only one of the vertical grooves 3 is visible in FIG. 1. Also on the sides of the base 1 are three grooves 10 oriented close to the horizontal, which will be referred to as "horizontal grooves". Only one horizontal groove 10 and part of another are visible in FIG. 1. Each vertical groove 3 meets one of the horizontal grooves 10 to create an L-shaped configuration. Each of the horizontal grooves 10 has another groove 11 branching off from it that runs up to the top of the base 1. Catch pieces 4 cross two of the horizontal grooves 10. The catch pieces 4 consist of a long flat stick of the same material as the base 1 and an angled portion at the top 13. Each catch 4 is fixed to the base 1 at the bottom and is flexible. The two catch pieces 4 rest in two additional grooves parallel to the vertical grooves 3. The two catch pieces are located 120 degrees from each other and are on the back half of the base, opposite the foot 5 (see FIG. 8A).

Figure 2:
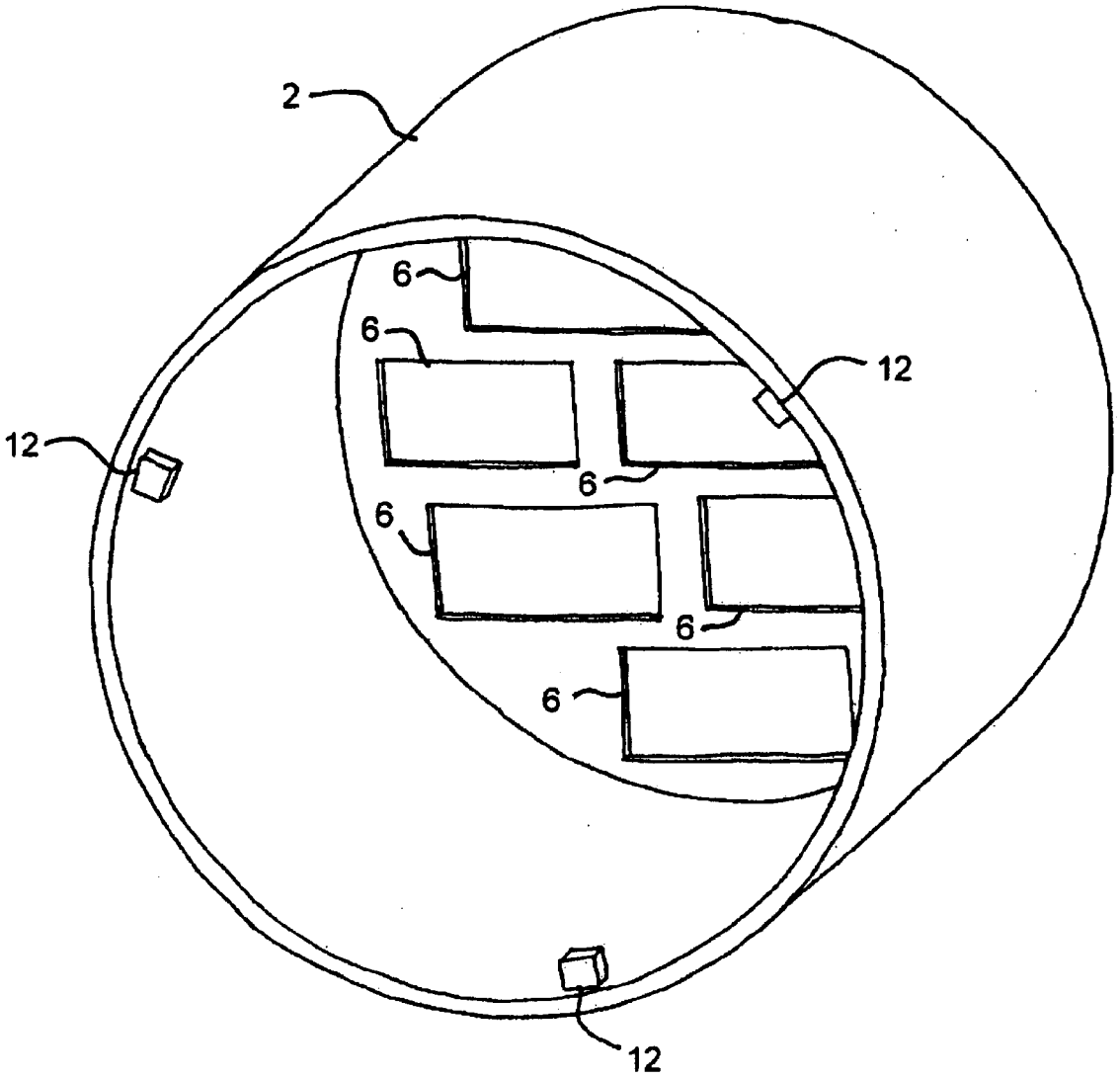
FIG. 2 is a perspective view of the cap piece.

Referring to FIG. 2, the second part of the knife block is the cap piece 2, and it is made of a clear or translucent plastic polymer of a depth and circumference to fit snugly around the cylindrical part of the base. The cap has holes 6 in its top that are designed to allow the knife handles to pass through when the holes and handles align. Three protrusions 12 are located at the bottom of the cap 2. The protrusions 12 are spaced equally around the bottom of the cap 2. If the bottom of the cap 2 is visualized as a clock, the protrusions 12 are placed at two o'clock, six o'clock and ten o'clock.

Referring to FIGS. 1 and 2, the protrusions 12 fit into the vertical grooves 3 and horizontal grooves 10 in the base 1 to guide the motion of the cap 2. The rising and lowering motion of the cap 2 is guided by the protrusions 12 moving in the vertical grooves 3. The rotating motion of the cap 2 is guided by the protrusions 12 moving along the horizontal grooves. The short groove 11 allows the cap 2 to be removed from the base 1 for the purpose of cleaning.

Figure 3:
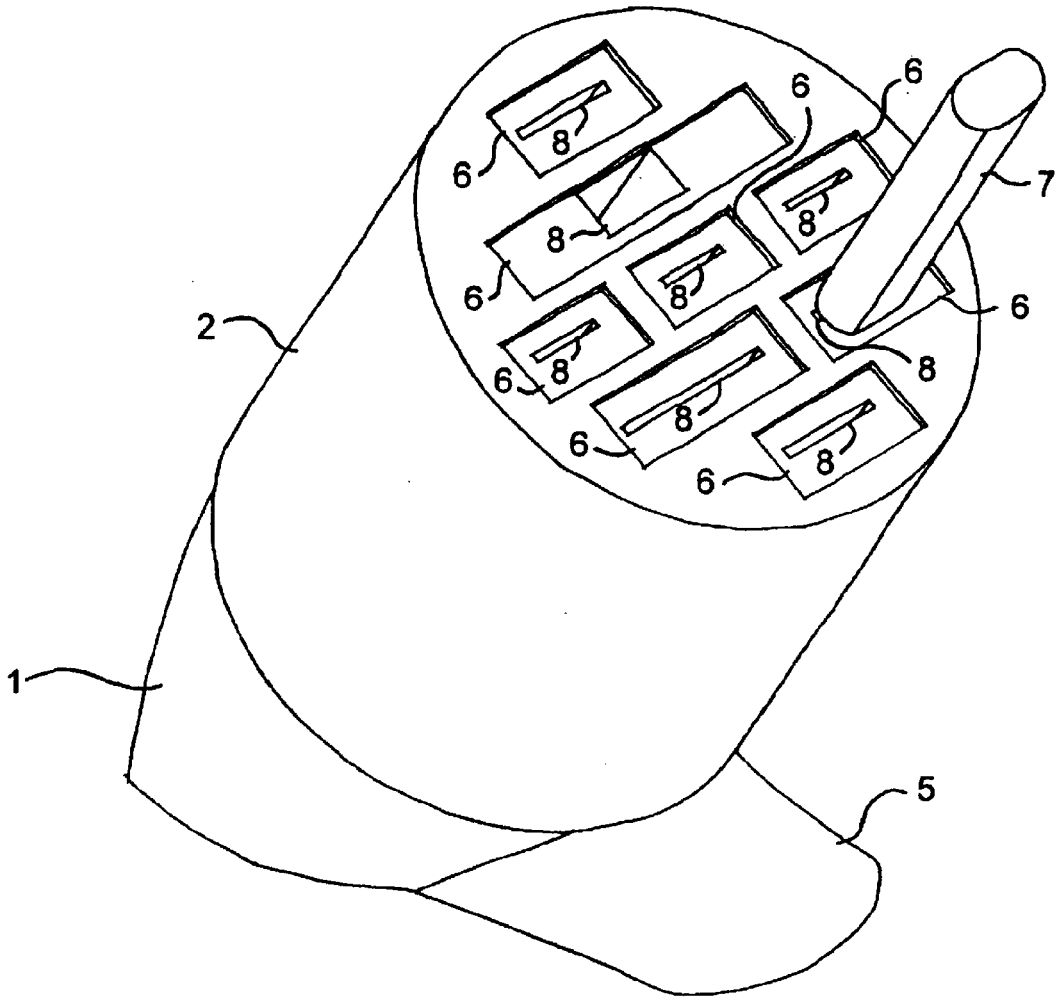
FIG. 3 is a perspective view of this lockable knife block in the unlocked position with cap down snugly over the base and a knife handle sticking out through a hole in the cap.

FIG. 3 shows the unlocked knife block assembly. In this position, the cap 2 fits down over the base 1 with the knife handle 7 protruding through the holes 6 in the cap 2. The holes 6 in the cap 2 are aligned with the knife handle 7 and the slots 8 in the base 1, and the knives are accessible to the user (see FIG. 7B). In addition, the protrusions in the cap 2 are at the bottom of the vertical grooves in the base 1, although this is not visible in FIG. 3.

Figure 4:
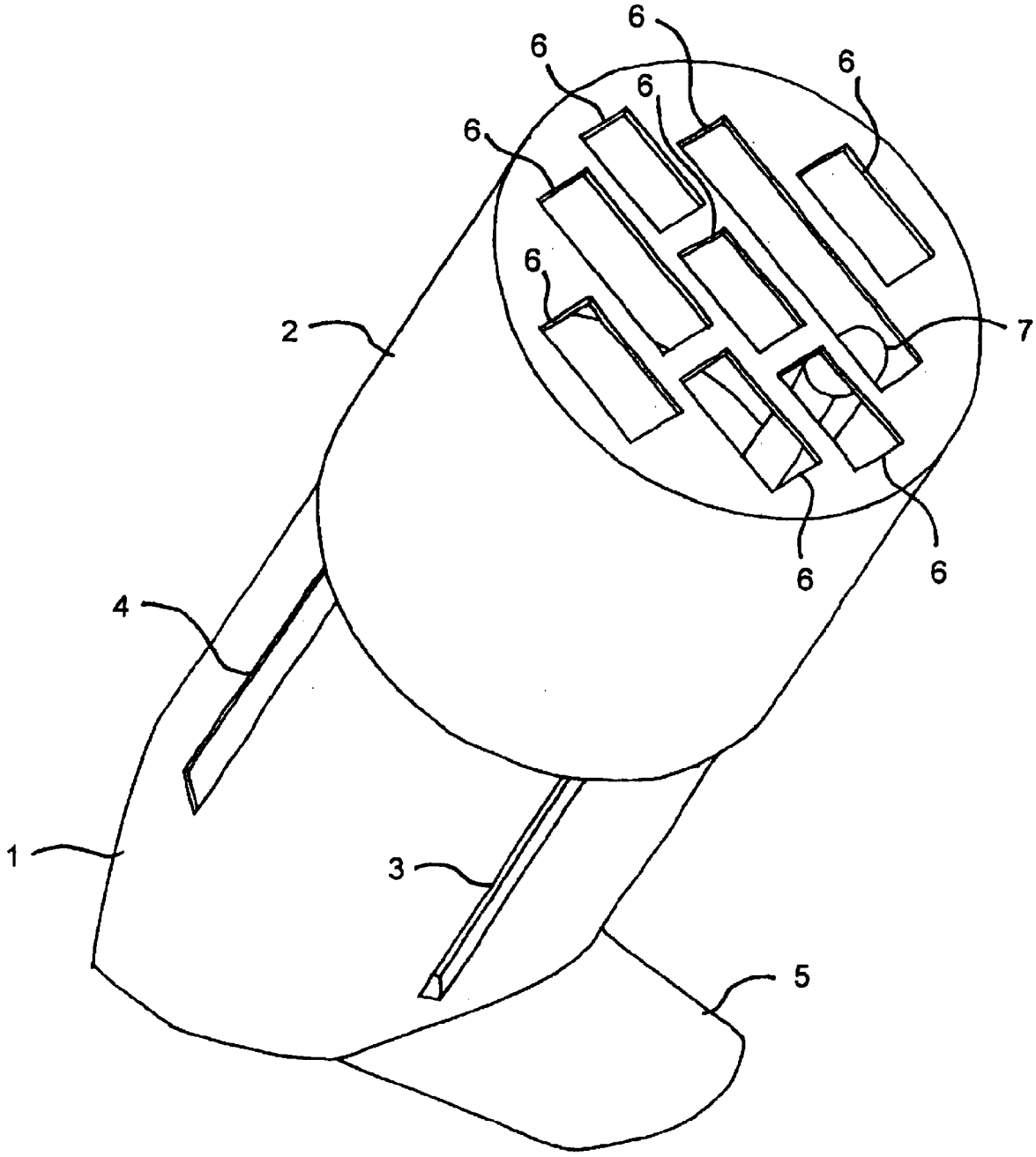
FIG. 4 is a perspective view of this lockable knife block in the locked position with the cap up, confining the cutlery.

FIG. 4 shows the locked knife block assembly. In this position, the cap 2 is raised so that the knife handle 7 is completely inside the cap 2. In addition, the cap 2 is rotated 90 degrees from the unlocked position so the holes 6 are oriented to block the knife handle 7 from passing through them (see FIG. 7A). When the cap 2 is in the locked position, two catch pieces 4 hold the protrusions in place and restrict the movement of the cap 2. To unlock the knife block assembly, the user depresses the catch pieces 4 with thumb and forefinger and rotates the cap 2 ninety degrees with the other hand. The protrusions in the cap 2 follow the horizontal grooves 10 until they reach the vertical grooves 3, and then the user lowers the cap 2 down onto the base 1 and the knife block assembly is unlocked as shown in FIG. 3.

Figure 5:
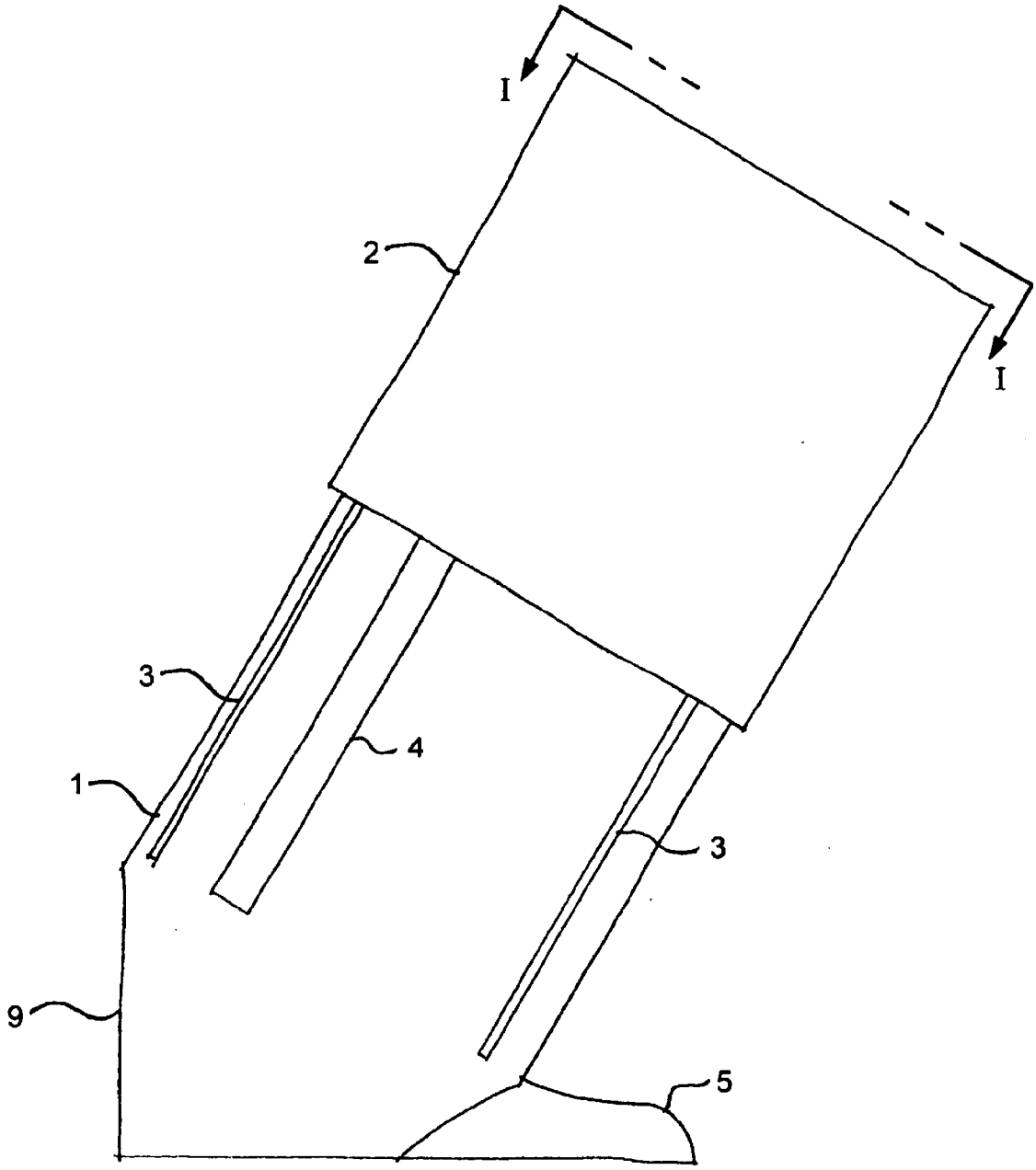
FIG. 5 is a side elevation of FIG. 4.

FIG. 5 shows the knife block assembly in the locked position. The back 9 of the base 1, opposite the foot 5, is truncated to allow the knife block assembly to be placed against the back wall of a kitchen countertop.

Figure 6:
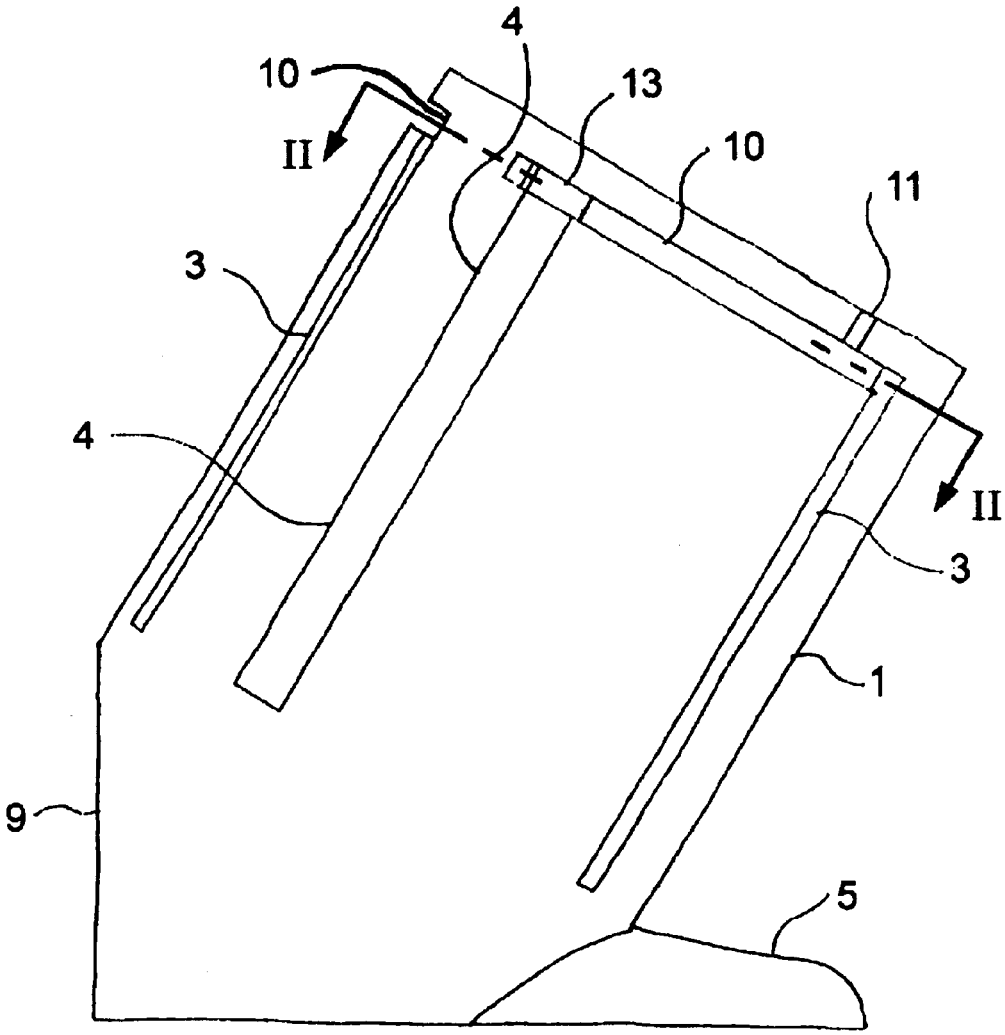
FIG. 6 is a side elevation of FIG. 1.

FIG. 6 shows the base of the knife block assembly.

Figure 7A:
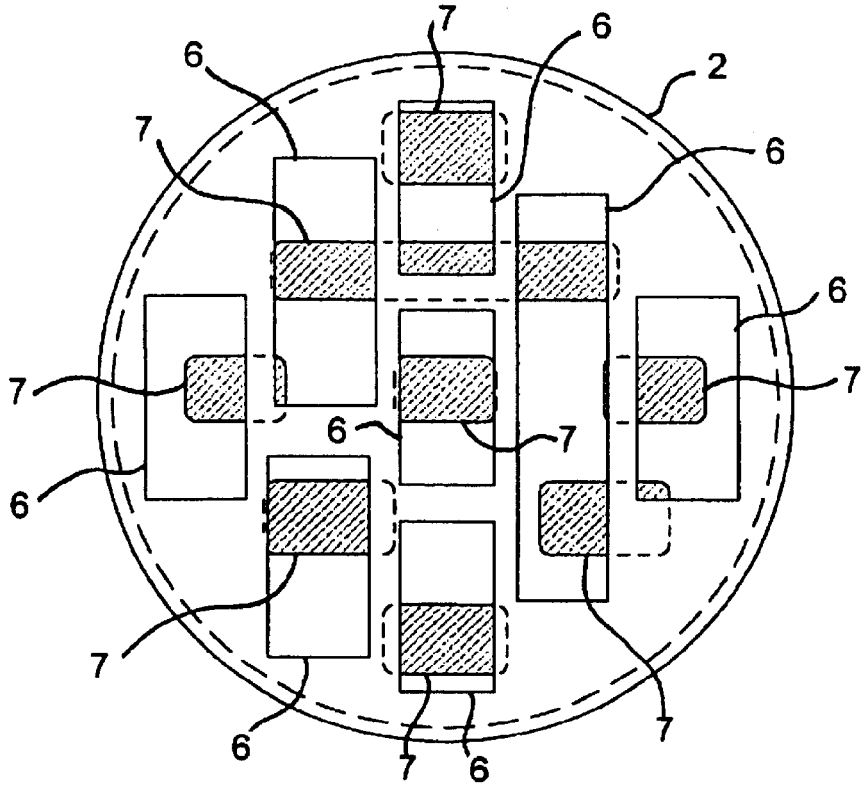
FIG. 7A is an elevation of the top of the cap piece in the locked position and is indicated by the I—I line in FIG. 5.

FIG. 7A shows the knife block assembly in the locked position. The orientation of the holes 6 in the cap 2 are 90 degrees away from the orientation of the knife handles 7 and the slots 8 in the base 1, confining the knives within the cap 2.

Figure 7B:
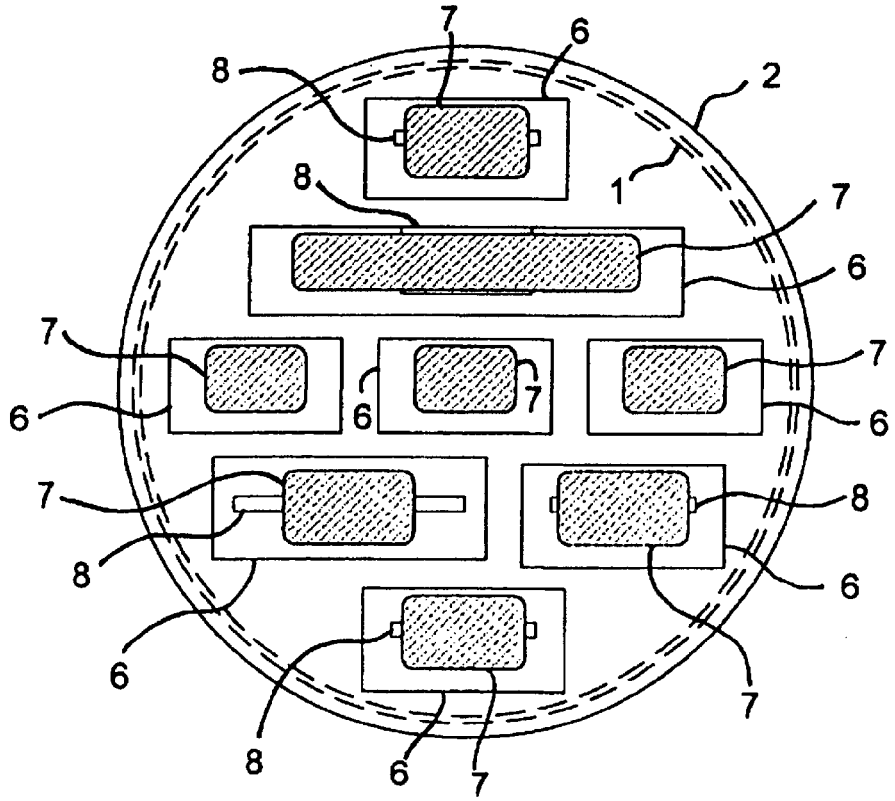
FIG. 7B is similar to FIG. 7A but shows the cap piece and base in the unlocked position.

FIG. 7B shows the knife block assembly in the unlocked position. The orientation of the holes 6 in the cap 2 matches the knife handles 7 and the slots 8 in the base 1, making the knives accessible.

Figure 8A:
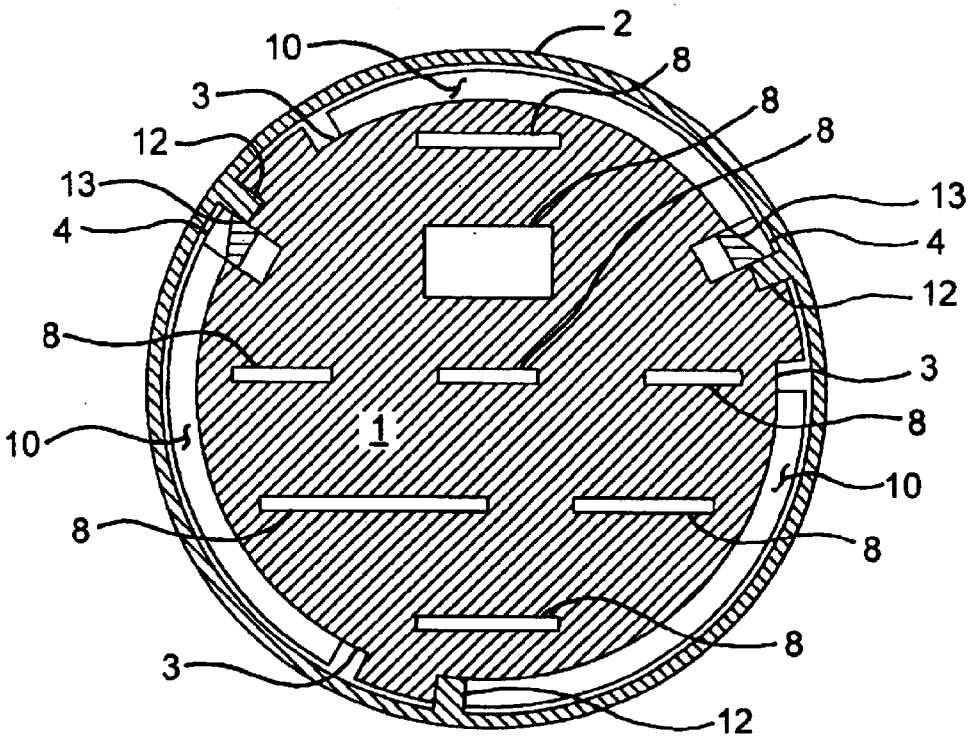
FIG. 8A is a cross section through the base and cap when the knife block assembly is in the locked position and is indicated by the II—II line in FIG. 6.

FIG. 8A shows the locked position. The catch pieces 4 block the protrusions 12 of the cap 2, thus preventing the motion of the cap. Specifically, it is the wider sides of the angled top portions 13 of the catch pieces 4 that block the movement of the protrusions 12. The narrower side of the angled top portion 13 of the catch piece 4 is flush with the inside of the horizontal groove 10. The main body of the catch piece 4 is flush with the outside surface of the base 1.

Figure 8B:
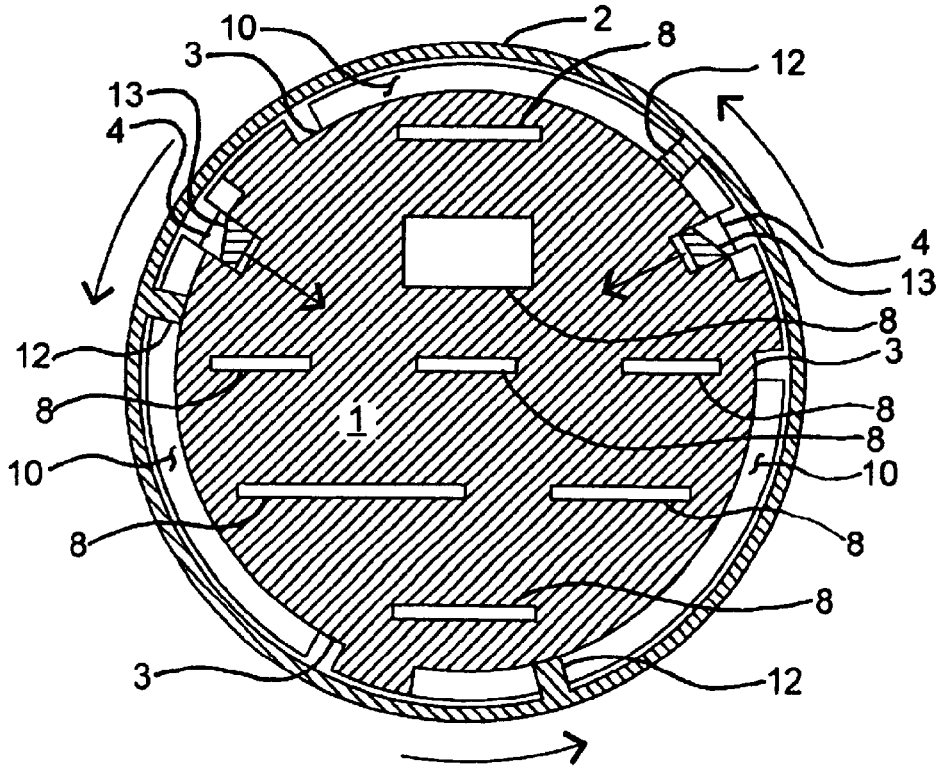
FIG. 8B is similar to FIG. 8A but the catch piece is depressed so it does not block the movement of the cap, which is rotating toward the unlocked position.

FIG. 8B shows the catch piece 4 when depressed by the thumb or index finger of the user, which frees the protrusion 12 to allow rotation of the cap 2. The protrusions are shown moving along the horizontal grooves 10 as the cap 2 rotates.

Figure 8C:
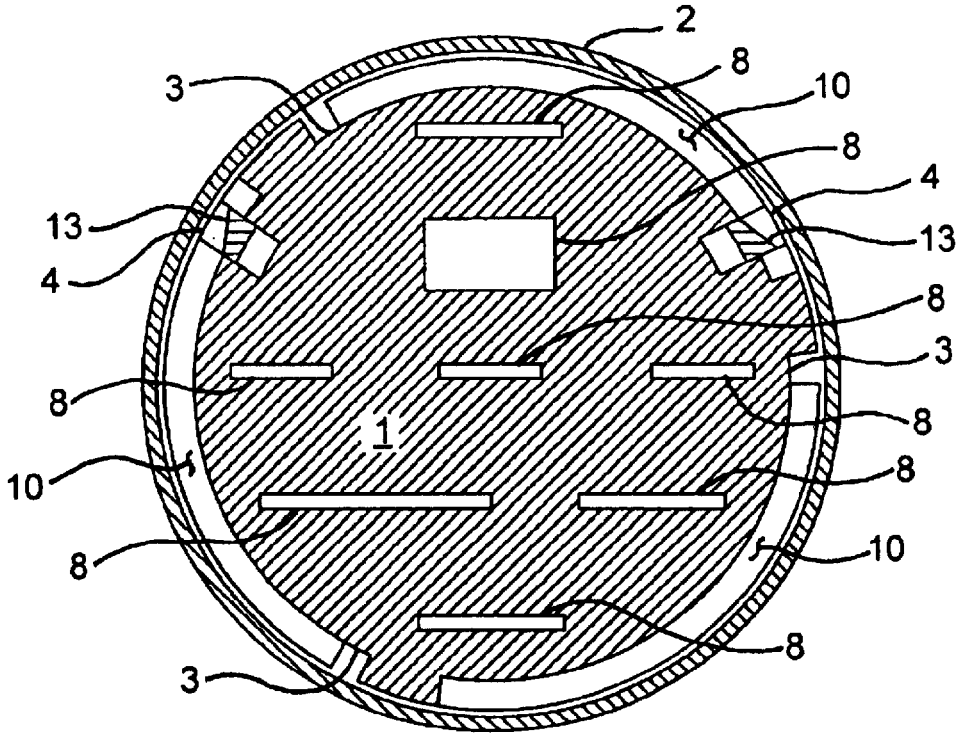
FIG. 8C is similar to FIG. 8A but the knife block assembly is in the unlocked position.

FIG. 8C shows the cap in the unlocked position. The protrusions are not shown because they are at the bottom of the vertical grooves 3, and the section is cut near the top of the base as shown in FIG. 6 line II—II. The catch 4 is in its normal un-depressed position.

Figure 8D:
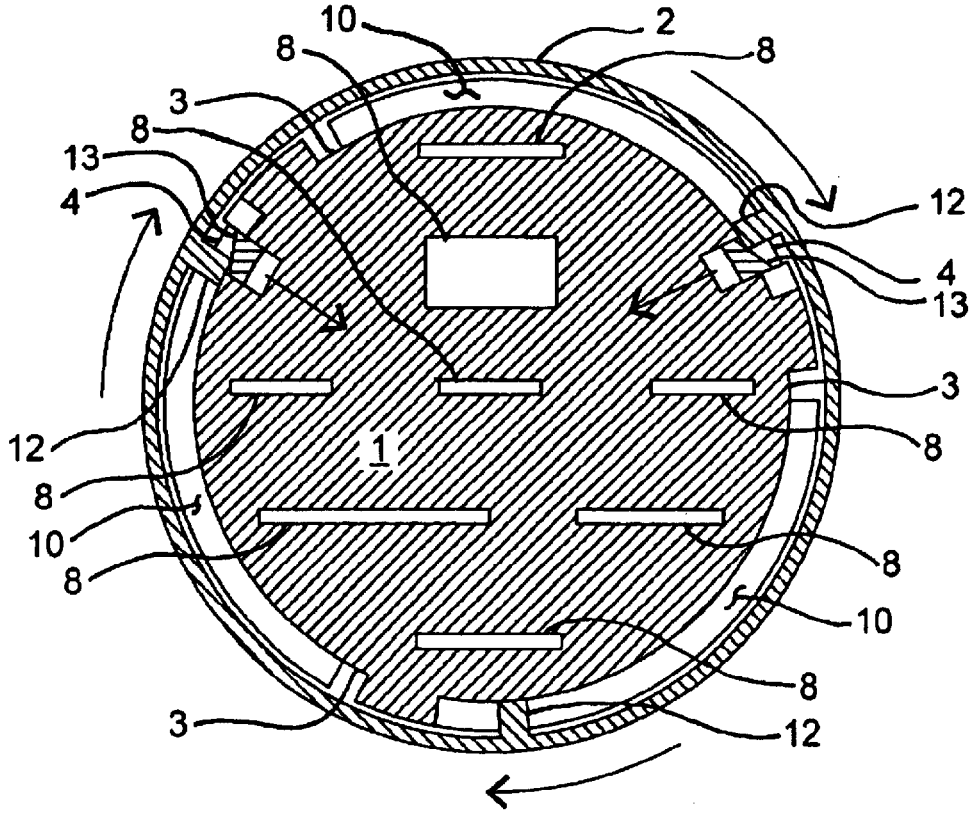
FIG. 8D is similar to FIG. 8A but the cap piece is rotating toward the locked position and has partially depressed the catch piece.

FIG. 8D shows the cap 2 rotating toward the locked position. The angle of the catch top portions 13 causes the catch pieces 4 to depress as the protrusions 12 of the cap 2 rotate. The next thing to happen after what is shown in FIG. 8D is that the protrusions 12 pass the angled portions 13, and the catch pieces 4 return to their normal un-depressed positions, blocking the movement of the protrusion 12, and locking the knife block assembly as shown in FIG. 8A.

What is claimed is:

1. A lockable knife block assembly comprising the following:

a generally solid base with a plurality of slots for storing knife blades;

a cap piece that secures to said base piece to lock the knives;

said can piece fits snugly over said base in an unlocked position with knife handles protruding through a plurality of holes in the top of said can piece, leaving knives accessible;

said cap piece has protrusions on the inside that slide in grooves on the sides of said base to guide movement of said cap piece to allow raising and then rotating of said cap piece so that said plurality of holes no longer align with knife handles, thereby confining knives within said cap piece;

catch pieces on the sides of said base restrain the movement of said protrusions once said cap piece is rotated to the full extent allowed by said grooves, thereby locking said cap piece in place;

said catch pieces are depressible to release said cap piece to move back to said unlocked position by rotating said cap piece so said holes align with knife handles and then lowering said cap piece so knife handles protrude.

* * * * *